United States Patent [19]

Zabcik

[11] 4,246,765

[45] Jan. 27, 1981

[54] SHOCK ABSORBING SUBASSEMBLY

[75] Inventor: Clarence J. Zabcik, Houston, Tex.

[73] Assignee: NL Industries, Inc., New York, N.Y.

[21] Appl. No.: 1,824

[22] Filed: Jan. 8, 1979

[51] Int. Cl.[3] ..... E21B 17/07; F16D 3/06

[52] U.S. Cl. ..... 64/23; 64/1 V

[58] Field of Search ..... 64/23, 1V

[56] References Cited

U.S. PATENT DOCUMENTS

| | | | |
|---|---|---|---|
| 1,609,851 | 12/1926 | Wilson | 64/23 |
| 3,325,837 | 6/1967 | Hartmann | 64/23 X |
| 3,345,832 | 10/1967 | Bottoms | 64/23 |
| 3,383,126 | 5/1968 | Salvatori et al. | 64/23 X |
| 3,406,537 | 10/1968 | Falkner | 64/23 |
| 3,858,669 | 1/1975 | Jeter | 64/23X |
| 3,871,193 | 3/1975 | Young | 64/23 |
| 4,031,716 | 6/1977 | Zabcik | 64/23 |
| 4,133,516 | 1/1979 | Jürgens | 64/23 X |
| 4,139,994 | 2/1979 | Alther | 64/23 |
| 4,173,130 | 11/1979 | Sutliff et al. | 64/23 |
| 4,181,344 | 1/1980 | Gazda | 64/23 X |

*Primary Examiner*—Henry K. Artis

*Attorney, Agent, or Firm*—Arnold, White & Durkee

[57] ABSTRACT

A shock absorbing subassembly, for use in an oil well drilling string above a drilling bit to absorb and reduce bit induced vibration and impact loads, wherein a shock absorber element is provided which includes at least one set of ring springs.

The ring springs comprise alternating closed outer rings and closed inner rings with tapered contact surfaces on the outer and inner rings.

16 Claims, 4 Drawing Figures

SHOCK ABSORBING SUBASSEMBLY

BACKGROUND OF THE INVENTION

1. Field of the Invention

The invention relates to shock absorbing subassemblies used in oil and gas well drilling operations, which are used for absorbing and reducing vibrations, shocks, or impact loads imparted to the drilling string from the drill bit during drilling operations.

2. Description of the Prior Art

In drilling oil and gas wells on land or in offshore environments, the drill bit generates considerable impact loads, shocks, and vibrations which, if allowed to be transmitted into the drilling string through the drill collar connecting the string and bit, could cause metal fatigue and eventual cracking and failure of the collar. Additionally, the impact loads, shocks, and/or vibrations, affect the length of the drill bit life, and prevent the drill bit from being continuously maintained against the bottom of the hole being drilled.

Accordingly, the art has provided shock absorbing subassemblies disposed in the drilling string above the drilling bit to isolate bit induced vibration, shocks, and impact loads from the drill string above the subassembly. Such shock absorbing subassemblies utilize a splined engagement between a mandrel and an elongated body, whereby drilling torque is transmitted through the splined engagement between the mandrel and the body. The splined section also permits upward and downward movement of the body, with respect to the mandrel, which in turn applies impact loads to the shock absorber element of the shock absorbing subassembly. An illustrative example of such a shock absorbing subassembly is that disclosed in U.S. Pat. No. 3,406,537, issued to C. B. Falkner, Jr. on Oct. 22, 1968. The shock absorbing subassembly disclosed therein, utilizes a plurality of discs made of stainless steel wire, woven into a cloth-like mesh. Other shock absorbing subassemblies known in the art utilized helical springs, blocks of elastomer materials, or thin elastomer rings covered by separate, special shaped steel cups, as the shock absorber elements.

One of the problems associated with shock absorbing subassemblies, which utilize elastomer materials or woven wire mesh material as the shock absorber element, is that after a period of time such materials may take a permanent set, whereby the spring constants of these materials may greatly increase. Accordingly, a much greater load would need to be applied to the shock absorber in order to give the desired compression of the shock absorber element and deflection between the mandrel and body. In other words, the taking of a permanent set of the shock absorber element results in reduced elasticity thereof, which results in poorer shock absorbing characteristics of the shock absorber subassembly.

In the case of shock absorbing subassemblies which utilize helical springs as the shock absorber element, the use of such springs having high spring constants provides adequate dampening characteristics for high impact loads; however, the deflection and dampening characteristics for lower loads may be unsatisfactory. If a helical spring having a low spring constant is utilized as the shock absorber element, adequate dampening and deflection characteristics are exhibited in the lower impact load range; however, in the high impact load range a much longer spring must be utilized to provide the necessary dampening affect. The use of such an elongated spring necessitates a greatly increased length for the body and mandrel, whereby the costs of the shock absorbing subassembly are increased.

Accordingly, prior to the development of the present invention, there has been no shock absorbing subassembly available which utilizes a shock absorber element which does not take a permanent set, has the shortest possible subassembly length for greater economy and ease of handling and serviceability, and provides efficient absorption of vibrations, shocks, and impact loading, over high and low ranges of impact loading. Therefore, the art has sought an efficient, durable, economical, short, easily handled, easily serviceable, and versatile shock absorbing subassembly for use in oil and gas well drilling operations.

SUMMARY OF THE INVENTION

In accordance with the invention, the foregoing advantages have been achieved through the present shock absorbing subassembly. The shock absorbing subassembly of the present invention comprises a body having a longitudinally extending bore, a mandrel non-rotatably received in said body and forming an annular chamber therebetween, means for providing limited relative longitudinal movement between said mandrel and body; seal means between said mandrel and body for sealing off said annular chamber opposed load transmitting surfaces on said mandrel and body within said chamber for transmitting longitudinal thrust loading between said mandrel and body; and a shock absorber element, including at least one set of ring springs, positioned within said annular chamber in thrust transmitting relationship between said opposed surfaces for absorbing and reducing vibrations and impact loads applied to the ring springs by the opposed load transmitting surfaces of the mandrel and body.

As indicated above, in more specific terms, the shock absorbing subassembly of the present invention includes using as the shock absorber element a first and second set of ring springs, the first set of ring springs having a higher spring constant than the spring constant of the second set.

The present invention also includes an improvement in a shock absorbing subassembly, for use in an oil well drilling string above a drilling bit to absorb and reduce bit induced vibration and impact loads, having a mandrel, a body non-rotatably and slidably mounted about said mandrel, and a shock absorber element, wherein the shock absorber element includes at least one set of ring springs.

As indicated above, in more specific terms, the shock absorber element includes a first and second set of ring springs, the first set of ring springs having a higher spring constant than the spring constant of the second set.

A feature of the present invention resides in the fact that the subassembly includes means for mounting the ring springs about the mandrel and between the body and the mandrel, and comprises a spring mandrel slidably mounted about the mandrel.

A further feature of the present invention resides in the fact that the mounting means may include a raised portion, with a first set of ring springs mounted on one side of the raised portion, and a second set of ring springs mounted on the other side of said raised portion. The first set of ring springs may have a higher spring constant than the spring constant of the second set, or the first and second set of ring springs may have substantially the same spring constants.

The shock absorbing subassembly of the present invention when compared with previously proposed prior art shock absorbing subassemblies has the advantages of efficiency, versatility, durability, shorter length, easy handling, easy serviceability, and lower cost.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
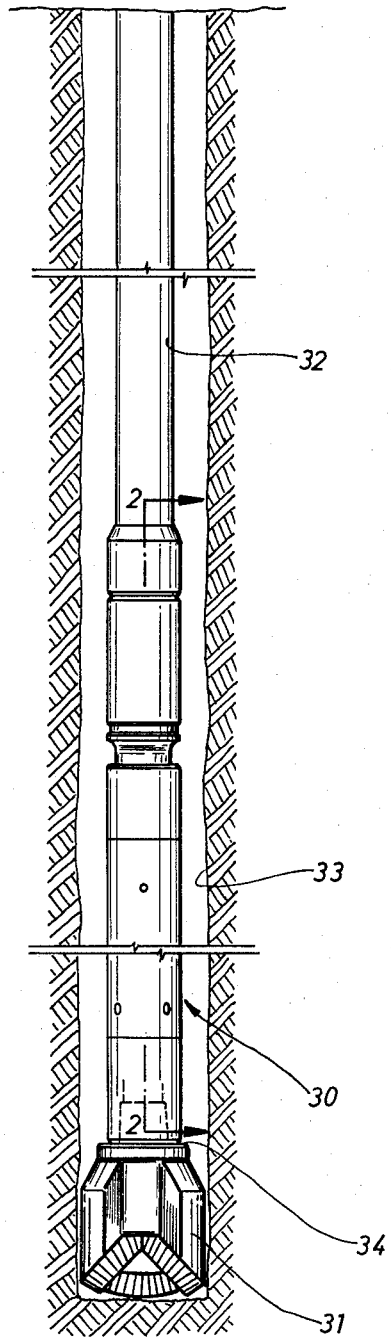
FIG. 1 is a plan view of the shock absorbing subassembly of the present invention, which shows it in its normal working environment.

Turning first to FIG. 1, the shock absorbing subassembly 30 of the present invention is shown in a conventional drilling string 32 disposed in the earth 33. At its lower end 34, a drill bit 31 is mounted in a conventional manner.

Figure 2A:
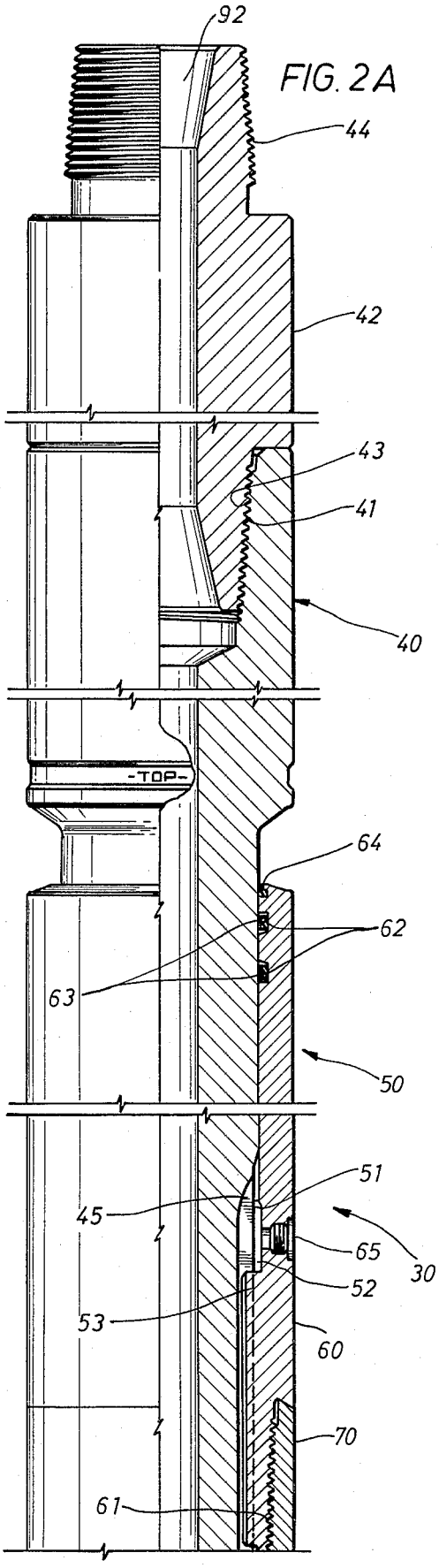
FIGS. 2A, 2B, and 2C are cross-sectional views of the shock absorbing subassembly of the present invention taken along line 2—2 of FIG. 1.
Figure 2B:
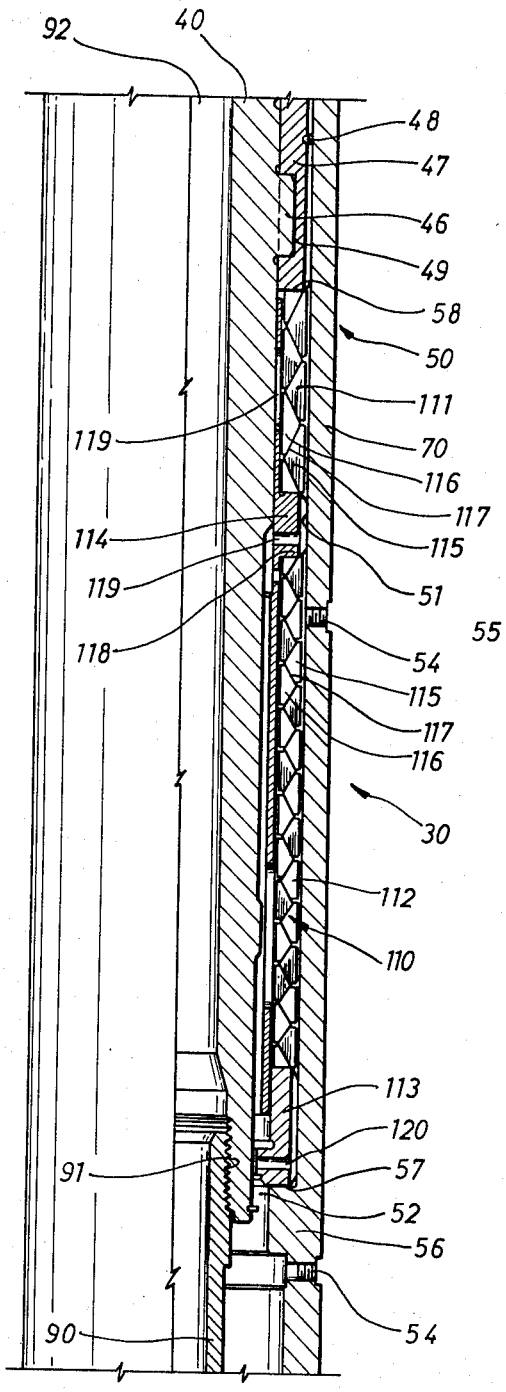
Figure 2C:
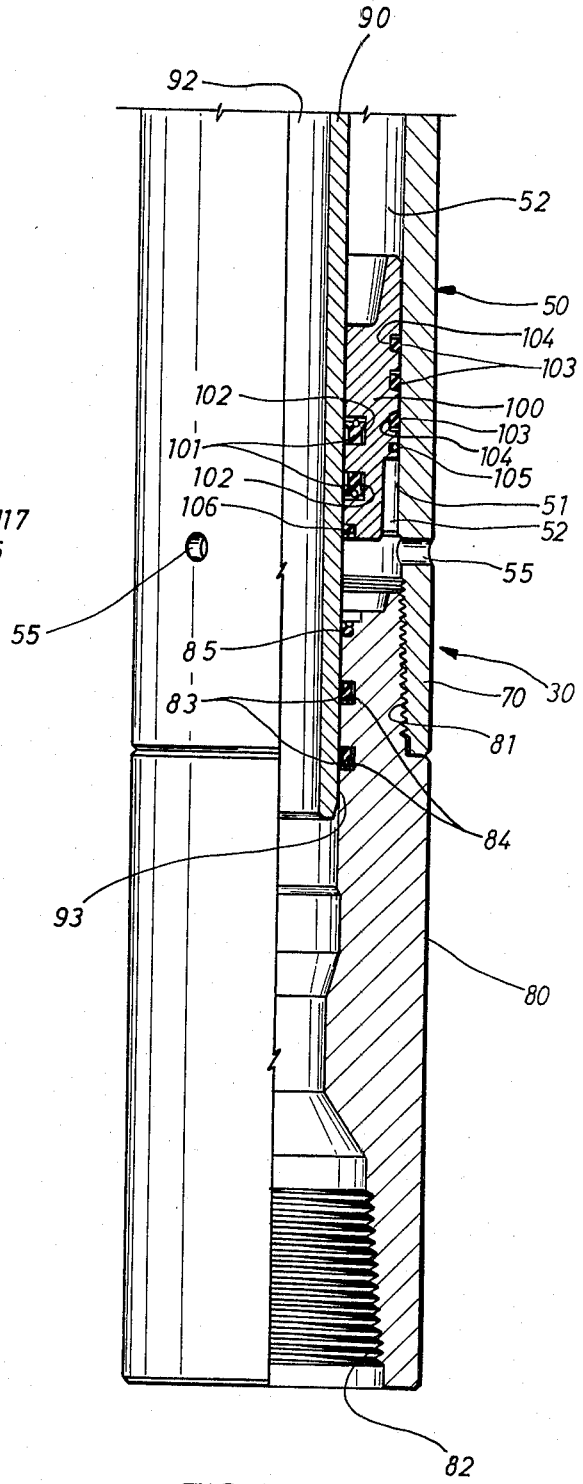

Turning now to FIGS. 2A, 2B, and 2C, the shock absorbing subassembly 30 of the present invention will be shown in greater detail. Shock absorbing subassembly 30 generally includes a mandrel 40, body 50, and shock absorber element 110. Body 50 has a longitudinally extending bore 51, in which mandrel 40 is received thus forming an annular chamber 32 between mandrel 40 and body 50.

Referring now to FIG. 2A, it is seen that mandrel 40 may have a threaded female connection 41 at its upper end for mating with a top sub 42. Top sub 42 has a threaded male connection 43 at its lower end, and a threaded male connection 44 at its upper end for mating with an optional tool joint box (not shown) which may be used to connect shock absorbing subassembly 30 to the drill string 32. Mandrel 40 is non-rotatably received in body 50 by means of a plurality of longitudinally extending splines 45 which mesh with corresponding longitudinally extending grooves 53 on bore 51 of body 50.

Referring now to FIGS. 2B and 2C, it is seen that mandrel 40 is also provided with additional splines 46 for cooperation with a split ring 47 and split ring retainer ring 48. Split ring 47 has a circumferential groove 49 which encloses splines 46 of mandrel 40. Mandrel 40 also includes a removable and replaceable washpipe 90 threadedly received at 91 in the lower end of mandrel 40. It is seen that mandrel 40, washpipe 90, and top sub 42 are provided with a longitudinally extending bore 92 which allows the downward passage of a suitable drilling mud (not shown) under high pressure to pass downwardly through the drilling string 32, shock absorbing subassembly 30, and to the bit 31. By means of the threaded connection 91 between mandrel 40 and washpipe 90, washpipe 90 may be easily replaced as the outer circumferential sealing surface 93 of washpipe 90 becomes worn. Outer sealing surface 93 may be chrome plated as necessary for a good sealing relationship with the lower portion of body 50. Thus, as the sealing surface 92 deteriorates, only washpipe 90 must be replaced, rather than an entire mandrel 40.

Body 50 includes drive sub 60 (FIG. 2A), a main body portion 70 (FIGS. 2B and 2C), and a bottom sub 80 (FIG. 2C). Drive sub 60 is connected to main body portion 70 by a suitable threaded connection 61, and bottom sub 80 is likewise connected to main body portion 70 by means of a suitable threaded connection 81. From FIG. 2C, it is seen that bottom sub 80 is provided with internal threads 82 for enabling shock absorbing subassembly 30 to be attached to a suitable tool joint box (not shown). Bottom sub 80 further includes suitable sealing means 83 disposed in interior circumferential grooves 84 of bottom sub 80 for providing a seal between the washpipe 90 of mandrel 40 and bottom sub 80 of body 50. It should be noted that sealing means 83 cooperates with the circumferential sealing surfaces 93 of washpipe 90, and provides for a seal to be effected about the smaller circumference of washpipe 90, rather than about the larger circumference of main mandrel portion 40, thus reducing the amount of hydraulic force. Bottom sub 80 may further be provided with a washpipe mud wiper 85.

Referring now to FIG. 2A, it is seen that drive sub 60 is provided with interior radial grooves 62 in which sealing means 63 are inserted, thus providing a seal means between mandrel 40 and drive sub 60 of body 50, to seal off annular chamber 52 from the exterior of body 50. Drive sub 60 may further be provided with a mandrel mud wiper 64 at the upper portion of drive sub 60. Drive sub 60 may further be provided with an oil inspection hole and plug 65 to enable annular chamber 52 to be filled with oil as to be hereinafter described. As previously discussed drive sub 60 includes the longitudinally extending grooves 53 for cooperation with splines 45 of mandrel 40, whereby mandrel 40 is non-rotatably received in body 50 and allows the transmission of torque to be applied to the shock absorbing subassembly 30 as a rotational force is applied to mandrel 40 via top sub 42. Longitudinally extending grooves 53 of drive sub 60 additionally allow a longitudinally sliding engagement between mandrel 40 and body 50, or limited relative longitudinal movement between mandrel 40 and body 50.

Turning now to FIGS. 2B and 2C, it is seen that main body portion 70 is also provided with oil inspection holes and plugs 54 for allowing chamber 52 to be filled with oil as to be hereinafter described, and may also include a plurality of vent holes 55 which communicate with the lower portion of annular chamber 52.

Referring to FIG. 2B, it is seen that main body portion 70 is provided with an interior circumferential depending flange or abutment 56, the top surface 57 of which forms a load transmitting surface within chamber 52 for transmitting longitudinal thrust loading between mandrel 40 and body 50. Load transmitting surface 57 cooperates with shock absorber element 110, which is disposed between load transmitting surface 57 and its opposed load transmitting surface 58, which is the lower end of split ring 47 associated with mandrel 40.

The improved shock absorber element of the present shock absorbing subassembly 30 will now be described with reference to FIG. 2B. It is seen that disposed within chamber 52 between opposed load transmitting surfaces 57 and 58 is a large ring spring assembly 111, a small ring spring assembly 112, thrust ring 113, and spring mandrel 114. The ring springs of large ring spring assembly 111 and small ring spring assembly 112 comprise alternating closed outer rings 115 and closed inner rings 116 with tapered contact surfaces 117. Spring mandrel 114 provides a means for mounting the ring springs of shock absorber element 110 about mandrel 40, and spring mandrel 114 is slidably mounted about mandrel 40 within annular chamber 52. Shock absorber element 110 may include only one set of ring springs, although in the preferred embodiment shock absorber element 110 includes the first set of ring springs in large ring spring assembly 111 and the second set of ring springs in small ring spring assembly 112. The spring constant of the first set of ring springs 111 is preferably higher than the spring constant of the second set of ring springs 112, as to be hereinafter described.

Spring mandrel 114 may include a raised portion, or outer circumferential rib, 118 which serves to separate the sets of ring springs 111 and 112. Spring mandrel 114 serves the following functions of providing support or stabilization to mandrel 40 in main body portion 70; acts as a centralizer or keeper for the sets of ring springs 111 and 112; and, in combination with thrust ring 113 and opposed load transmitting surfaces 57 and 58, provides an overload stop, whereby as body 50 slides relative to mandrel 40, thus compressing shock absorber element 110, the maximum amount of compression of shock absorber element 110 is predetermined by the length of spring mandrel 114. Spring mandrel 114, with or without rib 118, will serve the latter two functions. Spring mandrel 114 is provided with suitable openings or vents 119 to allow the passage of lubricating oil to fill the entire cavity 52, thus bathing the elements within chamber 52 with oil to lubricate the moving elements therein and to dissipate the effects of heat and friction generated by the compression of the sets of ring springs 111 and 112. Thrust ring 113 may likewise be provided with a suitable vent or opening 120 for the same purpose.

Turning now to FIG. 2C, it is seen that the shock absorbing subassembly 30 is provided with a floating seal assembly means 100 in the lower portion of annular chamber 52 for sealing off chamber 52, while still allowing for fluid movement of the lubricating oil in chamber 52 occurring during deflection or relative movement of the mandrel 40 within body 50. The floating seal assembly means 100, or floater, is slidably received between washpipe 90 and main body portion 70, and includes washpipe seals 101 mounted in interior circumferential grooves 102, and body seals 103 mounted in outer circumferential grooves 104. Floater 100 may also include a circumferential bore wiper 105 and washpipe mud wiper 106 as shown in FIG. 2C. Floater 100 may tend to move longitudinally of body 50 with the deflection or relative movement of the mandrel 40 within body 50. The floater 100 also compensates for thermal expansion of the hydraulic fluid, such as oil, within the annular chamber 52 defined between floater 100 and seals 63 between drive sub 60 and mandrel 40 (FIG. 2A).

To assemble the shock absorbing subassembly 30 of the present invention, washpipe 90 and top sub 42 are threadedly connected to mandrel 40. Drive sub 60 of body 50 is then placed onto mandrel 40 with the seals 63 and mud wiper 64 already assembled therein, with interior grooves 53 of drive sub 60 meshing with splines 45 of mandrel 40. Then split ring 47 is mounted about mandrel 40 with interior groove 49 of split ring 47 enclosing splines 46 of mandrel 40. Split ring retainer ring 48 is then mounted about split ring 47, whereby longitudinal sliding movement of drive sub 60 relative to mandrel 40 is limited. Spring mandrel 114 with the sets of ring springs 111 and 112 is then placed about mandrel 40 and thrust ring 113 is then disposed about the lower portion of mandrel 40. After those elements are in position, main body portion 70 is assembled about mandrel 40 and shock absorber element 110. Main body portion 70 is then threadedly connected to drive sub 60 via threaded connection 61. Floater 100 is then inserted into main body portion 70 about washpipe 90. Bottom sub 80, with seals 83 and wiper 85 already assembled therein, may then be threadedly connected to main body portion 70 via threaded connection 81, whereby it is in sliding contact with washpipe 90 of mandrel 40. The shock absorbing subassembly 30 is then filled with oil via oil plug 65 in drive sub 60, and after the subassembly 30 is filled with oil, a vacuum may be applied via plug 54 to ensure that all entrapped air has been removed from chamber 52 and that the chamber 52 is completely filled with oil. The shock absorber element 110 may be provided with a preloaded assembly.

Turning now to FIGS. 1 and 2B, the operation of the shock absorbing subassembly 30 of the present invention will be described. As the drilling string 32, shock absorbing subassembly 30, and drill bit 31 are caused to rotate through the earth 33, to drill the desired oil or gas well, considerable impact loads, shocks and/or vibrations, are upwardly transmitted via drill bit 31. As these loads are passed upwardly through bottom sub 80 to main body portion 70, main body portion 70 will be forced upwardly with respect to mandrel 40. By means of opposed load transmitting surfaces 57 on main body portion 70 and surface 58 of split ring 47 associated with mandrel 40, the upward impact load will compress shock absorber element 110 to dampen the effect of the upward impact load. Thus, the impact loads, shocks, and/or vibrations caused by the drilling process are absorbed and reduced by shock absorber element 110. At the same time the required rotational force from drilling string 32 is applied to drill bit 31 through shock absorbing subassembly 30 by means of the engagement of splines 45 of mandrel 40 with the interior grooves 53 of drive sub 60.

With regard to shock absorber element 110, it should be noted that in the course of drilling an oil and gas well, different drilling weight load levels are applied to shock absorbing subassembly 30 dependent upon the speed of drilling and type of soil being encountered by drill bit 31. A high range of drilling weight loads placed upon shock absorbing subassembly 30 would be in the range of 60,000 to 100,000 pounds, whereas a lower load range, which is normally encountered, would be from 5,000 to 60,000 pounds. Although the upper range of loads is not normally encountered, a shock absorbing subassembly should be designed to handle those infrequently encountered loads; however, in some instances, the loads encountered will be only in the lower range of loads. Therefore, in one embodiment of the present invention, shock absorber element 110 may only comprise one set of ring springs having a given spring constant to provide the necessary deflection, compression, and force dampening between body 50 and mandrel 40 to absorb and reduce loads within the lower load range. In such an embodiment, the set of ring springs could be mounted upon a spring mandrel which does not have raised portion 118, as shown in FIG. 2B, or spring mandrel 114 may be dispensed with and the single set of ring springs could be mounted in sliding engagement directly with mandrel 40. Alternatively, the spring mandrel 114 of FIG. 2B could be utilized with two sets of ring springs 111 and 112, wherein each set of ring springs 111 and 112 have substantially the same spring constant.

In those situations wherein not only low range loads, but also high range loads are encountered, the preferred embodiment of the present invention, wherein two sets of ring springs 111 and 112 are utilized and the first set 111 has a greater spring constant than that of the second set 112, provides an effective shock absorber element 110 which provides greater versatility for the shock absorbing subassembly 30, and at the same time allows a shorter length for the shock absorbing subassembly 30 to reduce manufacturing costs and to facilitate ease of handling, assembly, and serviceability. As lower loads are encountered by shock absorbing subassembly 30, these loads are absorbed by the small ring spring assembly 112 which has the lower spring constant. Because of the lower spring constant of the set of ring springs 112, they are more resilient and will be easily compressed by the forces applied to them via opposed load transmitting surfaces 57 and 58 of main body portion 70 and mandrel 40, whereas the large spring assembly 112 with its higher spring constant, will not be compressed as much. When a load is encountered in the upper load range, enough loading force will be applied not only to compress small ring spring assembly 112, but also large ring spring assembly 111, whereby the entire load will be absorbed and reduced by the shock absorber element 110.

The advantages of using ring springs as shock absorber element 110 rather than those utilized by the prior art, include: a high utilization factor or quality coefficient which means a lower weight and volume spring is required to be used to obtain the requisite amount of force dampening; a low rate of wear on the ring springs; and a long service life of the shock absorber element. Those qualities are in addition to the fact that ring spring shock absorber element 110 of the present invention will not take a permanent set as is the case in some prior art shock absorber elements utilized in shock absorbing subassemblies.

The foregoing description of the invention has been directed in primary part to a particular preferred embodiment in accordance with the requirements of the Patent Statutes and for purposes of explanation and illustration. It will be apparent, however, to those skilled in this art that many modifications and changes in this specific apparatus utilized may be made without departing from the scope and spirit of the invention. For example, instead of utilizing one or two sets of ring springs, three or more sets of ring springs could be utilized, or two sets of ring springs having different spring constants could be used, but they could directly abut one another.

It is applicant's intention in the following claims to cover such modifications and variations as fall within the true spirit and scope of the invention.

I claim:

1. In a shock absorbing subassembly, for use in an oil well drilling string above a drilling bit to absorb and reduce bit induced vibration and impact loads, having a mandrel, a body non-rotatably and slidably mounted about said mandrel, and a shock absorber element, the improvement which comprises:

said shock absorber element including at least one set of ring springs, said ring springs comprising alternating closed outer rings and closed inner rings with tapered contact surfaces on the closed outer and inner rings.

2. The improvement of claim 1 wherein said shock absorber element includes a first and second set of ring springs, the first set of ring springs having a higher spring constant than the spring constant of said second set.

3. The improvement of claim 2 which includes means for mounting said sets of ring springs about the mandrel and between the body and the mandrel and comprises a spring mandrel slidably mounted about the mandrel.

4. The improvement of claim 3 wherein said mounting means includes a raised portion for separating the first and second set of rings from one another.

5. The improvement of claim 1 which includes means for mounting said at least one set of ring springs about the mandrel and between the body and the mandrel and comprises a spring mandrel slidably mounted about the mandrel.

6. The improvement of claim 5 wherein said mounting means includes a raised portion and a first set of ring springs is mounted on one side of the raised portion, and a second set of ring springs is mounted on the other side of said raised portion, said first and second sets of ring springs having substantially the same spring constants.

7. The improvement of claim 1 wherein the mandrel is provided with a removable wash pipe.

8. The improvement of claim 7 wherein the body includes a removable bottom sub in sealing engagement with the wash pipe.

9. A shock absorbing subassembly, for use in an oil well drilling string above a drilling bit to absorb and reduce bit induced vibration and impact loads, said subassembly comprising:

a body having a longitudinally extending bore;

a mandrel non-rotatably received in said body and forming an annular chamber therebetween;

means for providing limited relative longitudinal movement between said mandrel and body;

seal means between said mandrel and body, for sealing off said annular chamber;

opposed load transmitting surfaces on said mandrel and body within said chamber for transmitting longitudinal thrust loading between said mandrel and body; and a shock absorber element; including at least one set of ring springs, positioned within said annular chamber in thrust transmitting relationship between said opposed surfaces for absorbing and reducing vibrations and impact loads applied to the ring springs by the opposed load transmitting surfaces of said mandrel and body, said ring springs comprising alternating closed outer rings and closed inner rings with tapered contact surfaces on the closed outer and inner rings.

10. The subassembly of claim 9 wherein said shock absorber element includes a first and second set of ring springs, the first set of ring springs having a higher spring constant than the spring constant of said second set.

11. The subassembly of claim 10 which includes means for mounting said sets of ring springs about the mandrel and between the body and the mandrel, said mounting means comprises a spring mandrel slidably mounted about the mandrel in said annular chamber.

12. The subassembly of claim 11 wherein said mounting means includes a raised portion for separating the first and second set of rings from one another.

13. The subassembly of claim 9 which includes means for mounting said shock absorber element about the mandrel in said annular chamber, said mounting means comprises a spring mandrel slidably mounted about the mandrel.

14. The subassembly of claim 13 wherein said mounting means includes a raised portion and a first set of ring springs is mounted on one side of the raised portion and a second set of ring springs is mounted on the other side of said portion, said first and second sets of ring springs having substantially the same spring constants.

15. The subassembly of claim 9 wherein the mandrel includes a removable wash pipe.

16. The subassembly of claim 15 wherein the body includes a removable bottom sub in sealing engagement with the wash pipe.

* * * * *